United States Patent [19]

Murata

[11] 4,066,277

[45] Jan. 3, 1978

[54] SKI BOOT HEEL BINDING HAVING IMPROVED UNLOCKING DEVICE

[75] Inventor: Masahiro Murata, Matsudo, Japan

[73] Assignee: Hope Co., Ltd., Tokyo, Japan

[21] Appl. No.: 728,164

[22] Filed: Sept. 30, 1976

[30] Foreign Application Priority Data

July 19, 1976 Japan ..... 51-85059

[51] Int. Cl.[2] ..... A63C 9/08

[52] U.S. Cl. ..... 280/626; 280/631

[58] Field of Search ..... 280/626, 631, 632

[56] References Cited

U.S. PATENT DOCUMENTS

| | | | |
|---|---|---|---|
| 3,727,935 | 4/1973 | Unger | 280/626 |
| 3,773,341 | 11/1973 | Mimeur | 280/632 |
| 3,778,073 | 12/1973 | Salomon | 280/632 |
| 3,836,163 | 9/1974 | Hashioka | 280/632 |

*Primary Examiner*—Robert R. Song

*Attorney, Agent, or Firm*—Emrich, Root, O'Keeffe & Lee

[57] ABSTRACT

A ski boot heel binding having a locking means for normally setting a pivotally mounted body to a heel holding position and allowing the body to be displaced to a heel releasing position when the locking means is retracted, is disclosed wherein a pair of upper and lower fulcrum means are provided rearwardly of the front end of an unlocking lever. The front end portion of said lever has the locking means operatively connected thereto, and arranged in such a manner that when the rear end of the lever is depressed downwardly, the lower front end portion of the lever engages with the lower fulcrum means to retract the locking means by operation of the leverage thereon and that when the same rear end of the lever is moved upwardly, the upper front end portion of the lever engages with the upper fulcrum means to retract the locking means by operation of the leverage thereon.

7 Claims, 8 Drawing Figures

SKI BOOT HEEL BINDING HAVING IMPROVED UNLOCKING DEVICE

BACKGROUND OF THE INVENTION

This invention relates to a ski boot heel binding which can be displaced to a heel releasing position at the will of the skier by a force applied downwardly or upwardly to an unlocking device.

A ski boot heel binding of this general type has been heretofore known as shown, for example, in U.S. Pat. No. 3,830,511. However, in the known heel binding, a downward depressing force or an upward pulling force has to be applied to different outer parts of the unlocking device to displace the heel binding to the heel releasing position at the skier's will, so that the unlocking operation of the binding is not convenient for the skier. Further, in the known heel binding, the unlocking device is associated with a special link locking assembly, so that the unlocking device thereof could not be applied to heel bindings employing any other link or cam locking assemblies.

SUMMARY OF THE INVENTION

The present invention relates to an improved unlocking device which is adapted to be used in combination with a ski boot heel binding which comprises a pivot member having a heel holding jaw at the front end thereof and pivotably connected to a supporting means on a base plate, and locking means for normally setting the pivot means to a heel holding position and allowing the pivot means to be displaced to a heel releasing position when the locking means is retracted. The improved unlocking device of the present invention comprises an unlocking lever, the front end portion of which is operatively connected to the locking means and the rear end of which projects outwardly beyond the pivot body, and a pair of upper and lower fulcrum means provided rearwardly of the front end of the unlocking lever and arranged in such a manner that when the rear end of the lever is depressed downwardly, the lower front end portion of the lever engages with the lower fulcrum means to retract the locking means by operation of the leverage, and that when the same rear end of the lever is moved upwardly, the upper front end portion of the lever engages with the upper fulcrum means to retract the locking means because of the leverage.

Preferably, the upper and lower fulcrum means include a pair of upper and lower pins, and the unlocking lever has upper and lower shoulders rearwardly of the front center end postion thereof to which the locking means is operatively connected. The front ends of the upper and lower shoulders are arranged to be engaged with the upper and lower pins when the lever is moved up and down, respectively.

The upper and lower fulcrum pins may be secured to the upper and lower portions of the pivot body or may be secured to the upper portions of the supporting means and the lower portion of the pivot means, respectively. In these cases, the central part of the front end portion of the lever is connected to the locking means by a rod extending through a horizontally elongated slot made through the pivot means.

Also, the upper and lower fulcrum pins may be secured to the upper and lower portions of the supporting means. In this case, the central part of the front end portion of the lever is connected to the locking means, disposed inside of the supporting means, by a rod extending through a horizontally elongated slot made through the supporting means.

Accordingly, a main object of the present invention is to provide a ski boot heel binding having an improved unlocking device wherein the unlocking operation can be effected very easily by a downward depressing force or an upward pulling force applied to the same outer rear end of an unlocking lever.

Another object of the present invention is to provide an improved unlocking device which can be applied quite easily to many types of heel bindings having different link or cam locking assemblies.

Other objects and features of the present invention will become apparent from the following detailed description of preferred embodiments thereof, when taken in conjunction with the accompanying drawings, in which:

DETAILED DESCRIPTION OF THE INVENTION

Figure 1:
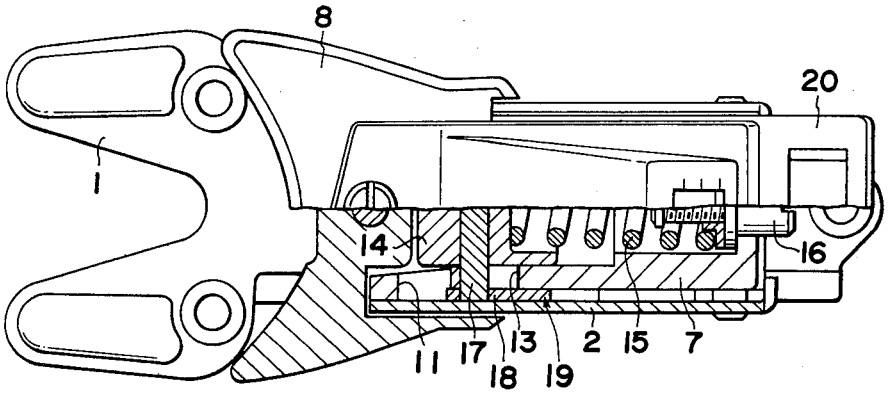
FIG. 1 is a plan view partly in section, showing a ski boot heel binding employing an unlocking device according to a first embodiment of the present invention.

Referring to FIG. 1 through FIG. 6, the ski boot heel binding according to a first embodiment of the present invention comprises a base plate 1 adapted to be mounted on a ski. A pair of vertical side frames 2—2 are provided, one at each side of the base plate 1, and are mounted to be slidable longitudinally thereof. The sliding movement of the side frames 2—2 is effected by an adjusting screw 3 extending through a vertical wall on the base plate 1 and acting against the rear end of a compression spring 4, the front end of which is received by a block 5 mounted on a pin 6 extending transversely of the base plate at the front lower end thereof and between the side frames 2—2. The compression spring 4 is used to exert a yieldable compression force in a forward direction against the boot heel when the ski boot is set on the ski by this binding and a cooperative toe binding (not shown).

Disposed between the side frames 2—2 is a pivotally mounted body member 7 which has a heel holding jaw member 8 at the front end thereof. The heel holding member 8 can be adjusted to a desired height by a screw-threaded rod 9, so as to firmly hold boot heels of different heights or thicknesses in the heel holding position thereof. The body 7 is swingably pivoted to the rear end of the side frames 2—2 by a shaft 10, so that the pivot body can rotate or swing up about the shaft 10 from the heel holding position to a heel releasing position. The pivoted body 7 has an arc-shaped vertically elongated slot 11 formed through the front end portion thereof with the center of its radius of curvature being the shaft 10. Extending transversely through the vertical slot 11 is a cross bar 12 secured at both ends thereof to the upper front end of the opposed side frames 2—2. The body 7 also has a horizontally extending elongated slot 13 therethrough adjacent to and rearwardly of the vertical slot 11.

Disposed within a longitudinal bore in the pivot body 7 is a cam member 14 which is urged against the secured cross bar 12 by a compression spring 15, the degree of compression of which is adjusted by an adjusting screw 16 extending outwardly beyond the pivot body at the rear end thereof. Extending through the cam member 14 is a rod 17, which also extends through the horizontal slots 13 in the pivot body 7 and terminates at each end thereof adjacent the inner surfaces of the side frames 2—2.

The rod 17 extending through the cam member 14 is connected at its ends to the forward ends of a pair of spaced arms 18—18 of an unlocking lever 19. The unlocking lever 19 has an outwardly projecting rear end 20 from which the spaced arms 18—18 extend, thereby providing a lever which is bifurcated in the vertical direction. Each arm 18 extends into a space between the inner surface of a side frame 2 and the outer surface of the pivot body 7. Each arm 18 of the unlocking lever 19 has a pair of upper and lower shoulders 21 and 22 located rearwardly of the forwardly extending central part thereof to which the rod 17 is connected.

Adjacent to the upper and lower shoulders 21 and 22 of each arm 18 of the lever 19 there is provided upper and lower pins 23 and 24 secured to the upper and lower portions of the pivot body 7, respectively. These upper and lower pins 23 and 24 extend toward the side frames 2—2, but terminate short thereof to allow the pivot body 7 to swing upwardly relative to the side frames. In the normal heel holding position of the binding shown in FIG. 2, the upper and lower pins 23 and 24 are in contact with the front ends of the upper and lower shoulders 21 and 22 of each arm 18 of the lever 19, respectively.

Figure 2:
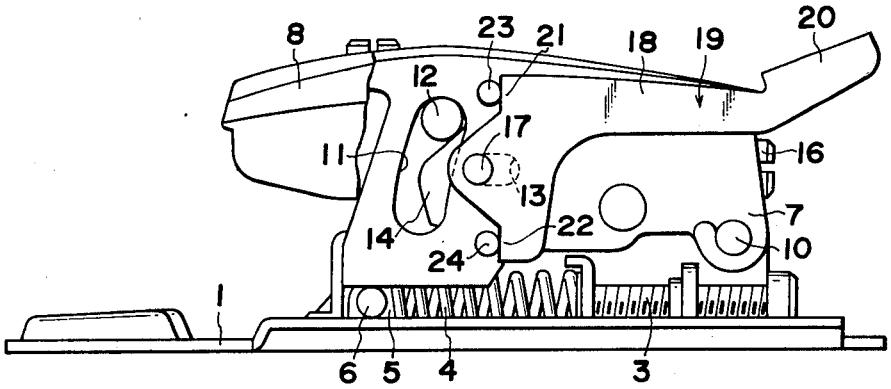
FIG. 2 is a side elevational view showing the heel binding of the first embodiment, illustrated in FIG. 1, but with the side frame thereof removed.
Figure 3:
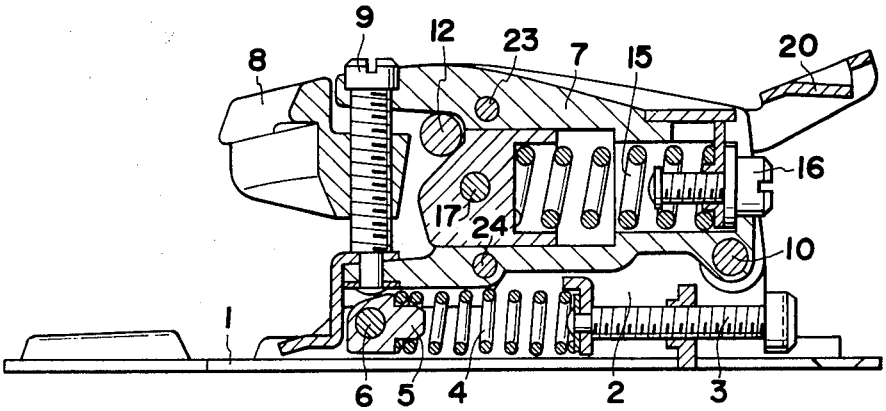
FIG. 3 is a longitudinal vertical sectional view showing the heel binding of the first embodiment illustrated in FIG. 1.

In the present heel binding in the heel holding position shown in FIGS. 1 to 3, the cam member 14, which is disposed within the longitudinal bore of the pivot body, is pressed against the lower section of the secured cross bar 12 by the compression force of the spring 15, whereby the pivot body 7 is prevented from swinging up about the shaft 10. When a severe upward thrust or shock is applied to the heel holding member 8 by a skier's boot, the heel holding member receives such a force as to cause the pivot body 7 to rotate about the shaft 10 and, thereby, the cam member 14 is retracted by the cross bar 12 against the compression force of the spring 15, which allows the pivot body to rotate or swing up about the shaft 10 toward a heel releasing position.

Figure 4:
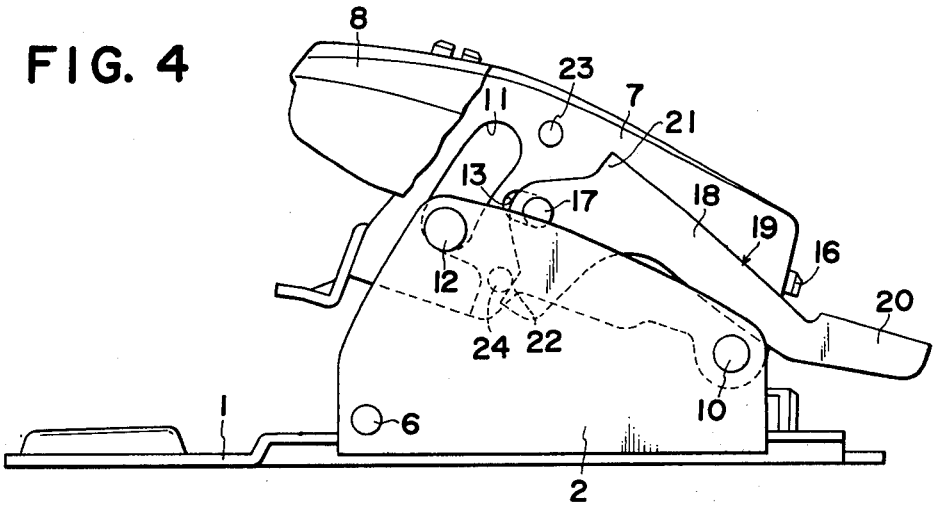
FIG. 4 is a side elevational view of the first embodiment showing the heel binding thereof after it has been displaced to a heel releasing position by depressing the unlocking lever downwardly.
Figure 5:
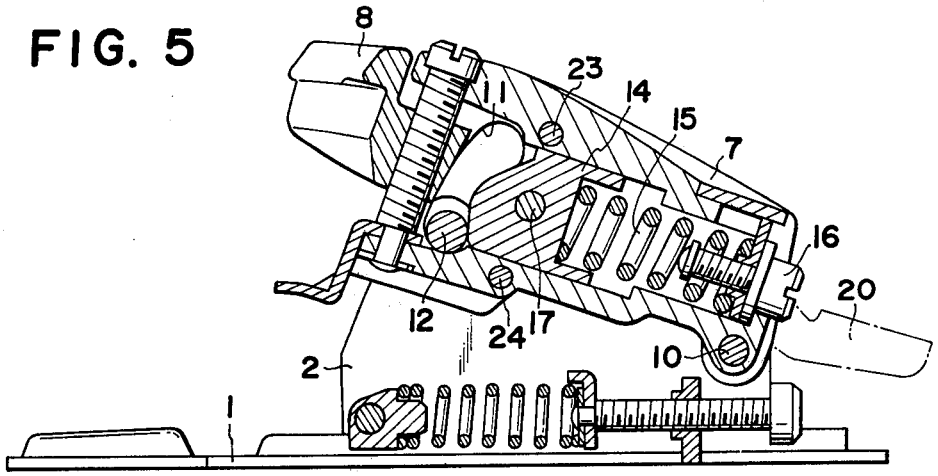
FIG. 5 is a longitudinal vertical sectional view of the heel binding in the heel releasing position shown in FIG. 4.

The present heel binding in the heel holding position can be displaced to the heel releasing position at the skier's will by depressing the rear end 20 of the unlocking lever 19 downwardly or pulling the same rear end 20 upwardly. That is, when the rear end 20 of the unlocking lever 19 is depressed downwardly, the lower shoulder 22 of each arm 18 of the unlocking lever 19 is pressed against the lower pin 24 and, due to a leverage, the rod 17 connected to the front end of the lever 19 and the cam member 14 connected to the rod are retracted along the horizontal slot 13 in the pivot body 7 as the contact point between the lever shoulder 22 and the lower pin 24 functions as the fulcrum of the leverage. Thus, when the front end of the cam member 14 is retracted enough beyond the rear end section of the cross bar 12, the pivot body is displaced to the heel releasing position as shown in FIGS. 4 and 5.

Figure 6:
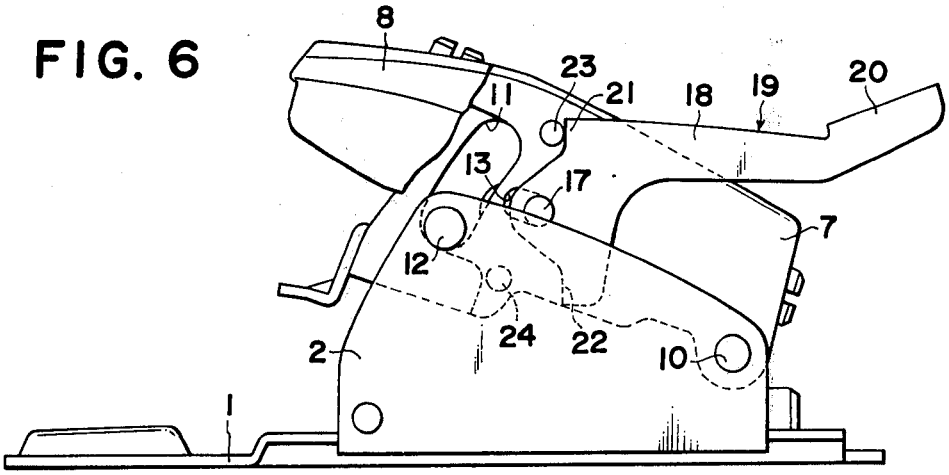
FIG. 6 is a side elevational view of the first embodiment showing the heel binding thereof after it has been displaced to the heel releasing position by pulling the unlocking lever upwardly.

On the other hand, when the rear end of the unlocking lever 19 is pulled upwardly and rearwardly in such a manner that the force applied to the upper fulcrum pin 23 by the upper shoulder 21 of the unlocking lever 19 is directed to a space between the centers of the cross bar 12 and rod 17, the contact point between the pin 23 and the upper shoulder 21 functions as a fulcrum and, due to the leverage, the rod 17 connected to the front end of the unlocking lever 19 and the cam member 14 connected to the rod are retracted as the rod 17 slides along the horizontal slot 13. Thus, the pivot body is displaced to the heel releasing position as shown in FIG. 6.

Preferably, in order to facilitate the displacement of the pivot body to the heel releasing position when the unlocking lever is depressed downwardly or pulled upwardly, a small spring for urging the pivot body to rotate about the shaft 10 may be provided between each frame and the pivot body.

Figure 7:
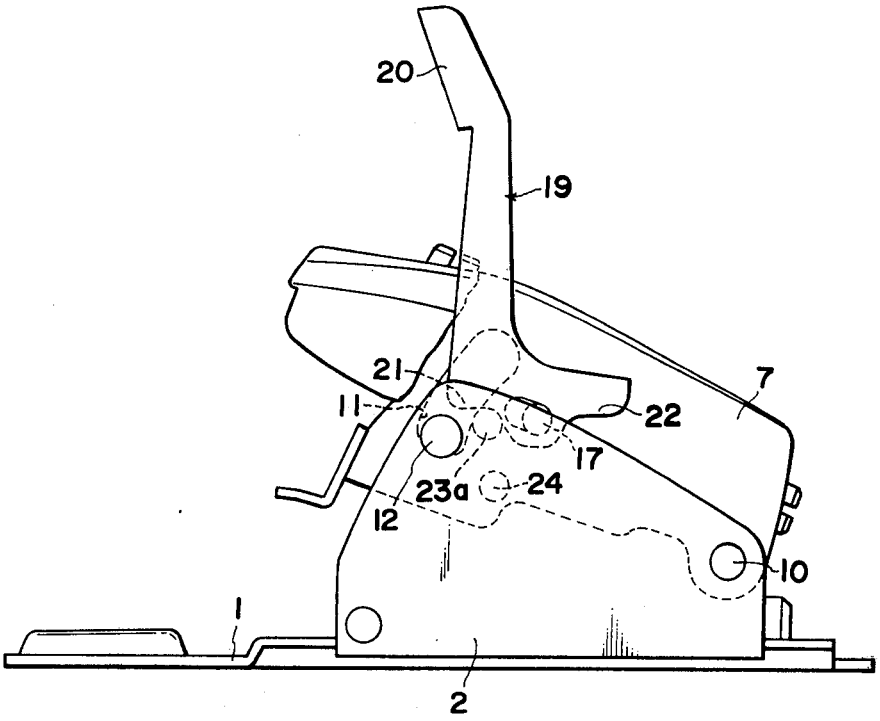
FIG. 7 is a side elevational view showing a ski boot heel binding after being displaced to the heel releasing position thereof and employing an unlocking device according to a second embodiment of the present invention in which the binding is displaced to the heel releasing position by pulling an unlocking lever upwardly.

Referring now to a second embodiment of the present invention shown in FIG. 7, the upper fulcrum pins 23*a* are secured to the front upper portion of the side frames 2—2, in place of being secured to the pivot body 7 as in the first embodiment. The upper fulcrum pins 23*a* project toward the pivot body 7 from the inner surface of the side frames but terminate short thereof to allow the pivot body 7 to rotate or swing up with respect to the side frames 2—2 about the shaft 10. The other features and structures of the second embodiment are substantially the same as those of the first embodiment.

In the heel holding position, the upper and lower shoulder 21 and 22 of each arm 18 of the unlocking lever 19 contact the rear ends of the upper pin 23*a* and the lower pin 24 at the front ends thereof, respectively. When it is desired to displace the pivot body to the heel releasing position by pulling up the rear end 20 of the unlocking lever 19, it is only required to pull the rear end 20 thereof vertically or toward the skier's leg wearing this binding, and not necessary to apply the rearwardly directed vertical pulling force to the lever end 20 as in the case of the first embodiment. In the second embodiment, when the unlocking lever 19 is pulled and rotated about an angle of 90° from the substantially horizontal heel holding position, the pivot body is displaced to the heel releasing position as shown in FIG. 7.

In the first and second embodiments set forth above, the unlocking lever 19 is provided in connection with the pivot body 7 to move therewith when the pivot body 7 rotates or swings up about the shaft 10. However, the unlocking lever may be provided in connection with a supporting body.

Figure 8:
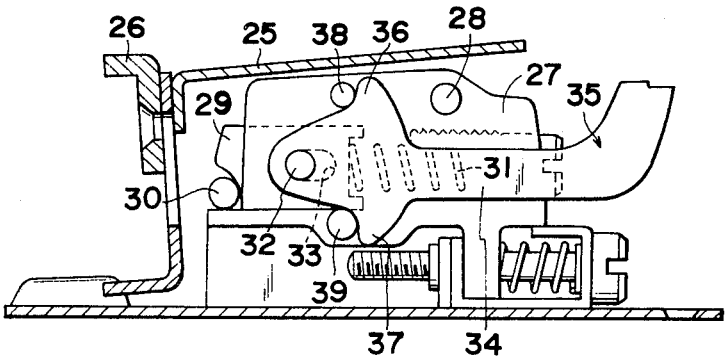
FIG. 8 is a side elevational view, partly in section, showing a ski boot heel binding in locked position and employing an unlocking device according to a third embodiment of the present invention.

In a third embodiment shown in FIG. 8, a swingable casing 25 having a heel holding piece 26 at the front end thereof is provided to enclose a supporting body 27 and pivoted thereto by a shaft 28. The supporting body has a cam member 29 therein, which is pressed against a cross bar 30 secured to the casing 25 by a compression spring 31. A rod 32 is provided through the cam member 29 and extends through horizontal slots 33 formed through side walls of the supporting body. Both ends of the rod 32 are connected to the center portion of the forwardly projecting front ends of bifurcated arms 34 of an unlocking lever 35, each arm 34 which is disposed between the outer side wall of the supporting body 27 and the inner wall of the casing 25. Each arm 34 of the unlocking lever has upper and lower shoulders 36 and 37, respectively, as in the cases of the first and second embodiments. A pair of upper and lower fulcrum pins 38 and 39 are secured to the upper and lower portions of the supporting body 27 and arranged to contact the front ends of the upper and lower shoulders 36 and 37 of the lever 35, respectively. These pins 38 and 39 extend outwardly from the supporting body 27 but terminate short of the casing, thereby to allow the casing to rotate about the shaft 28.

According to the third embodiment of the present invention, when the rear end of the unlocking lever 35 is depressed downwardly, the contact point between the lower pin 39 and the lower shoulder 37 functions as the fulcrum for the leverage and, therefore, the cam member 29 connected to the front end of the unlocking lever 35 by the rod 32 is retracted as the rod 32 slides back along the horizontal slot 33. Thus, when the engagement between the cam member 29 and the cross bar 30 is released, the casing is displaced to the heel releasing position by a swing-up spring (not shown). On the contrary, when the rear end of the unlocking lever 35 is pulled upwardly, the contact point between the upper pin 38 and the upper shoulder 36 functions as the fulcrum for the leverage and retracts the cam member 29 to release the engagement between the cam member 29 and the cross bar 30, thereby displacing the casing to the heel releasing position.

As may be understood from the disclosure set forth above, the heel binding employing the present unlocking device can be displaced to the heel releasing position by applying a downwardly depressing force or an upwardly pulling force to the same outer rear end of the unlocking lever. Also, since the present unlocking device utilizes the function of leverage, the structure thereof is very simple. Furthermore, the operation is reliable, and the force applied to the rear end of the unlocking lever for displacing the binding to the heel reacting position is relatively small. Still further, the present unlocking device can be applied to any kind of heel bindings employing cam or link locking assemblies which can be unlocked when retracted rearwardly.

Although the present invention has been described with reference to the preferred embodiments thereof, many modifications and alterations may be made within the spirit of the present invention.

I claim:

1. A ski boot heel binding comprising a base plate having front and rear end portions thereon and adapted to be mounted on a ski, supporting means mounted on said base plate, a pivotally mounted body member having a heel holding jaw at the front end thereof and pivotably connected to said supporting means, a retractable locking means for normally setting said body member to a heel holding position, said body member being displaced to a heel releasing position when said locking means is retracted, and an unlocking device for retracting said locking means, and unlocking device including an unlocking lever the front end portion of which is operatively connected to said locking means and the rear end of which projects outwardly beyond the rear end portion of said body member, and a pair of upper and lower fulcrum means provided rearwardly of the front end of said unlocking lever and arranged in such a manner that when the rear end of said lever is depressed downwardly, the lower front end portion of said lever engages with said lower fulcrum means to retract said locking means by operation of the leverage thereon, and when the same rear end of said lever is moved upwardly, the upper front end portion of said lever engages with said upper fulcrum means to retract said locking means by operation of the leverage thereon.

2. A ski boot heel binding as claimed in claim 1, wherein said upper and lower fulcrum means comprises a pair of upper and lower pins, and said unlocking lever has upper and lower shoulders located rearwardly of the central part of the front end portion thereof to which said locking means is operatively connected, the faces of said upper and lower shoulders being adapted to engage said upper and lower pins when said lever is moved up and down, respectively.

3. A ski boot heel binding as claimed in claim 2, wherein said upper and lower pins are secured to the upper and lower portions of said body member, respectively, and the central part of the front end portion of said lever is connected to said locking means by a rod extending through a horizontally elongated slot in said body member.

4. A ski boot heel binding as claimed in claim 2, wherein said upper and lower pins are secured to the upper portion of said supporting means and the lower portion of said body member, respectively, and the central part of the front end portion of said lever is connected to said locking means by a rod extending through a horizontally elongated slot in said body member.

5. A ski boot heel binding as claimed in claim 2, wherein said upper and lower pins are secured to the upper and lower portions of said supporting means, respectively, and the central part of the front end portion of said lever is connected to said locking means by a rod disposed inside of said supporting means and extending through a horizontally elongated slot in said supporting means.

6. A ski boot heel binding as claimed in claim 4, wherein said locking means includes a cam member disposed inside of said body member, and a cross bar extending through a substantially vertical slot formed in said body member and secured at both ends thereof to said supporting means outwardly of said body member, yieldable means for urging said cam member against said cross bar, and said rod being connected to said central part of the front end of said lever through said horizontally elongated slot in said body member.

7. A ski boot heel binding as claimed in claim 5, wherein said locking means comprises a cam member disposed inside of said supporting means, and a cross bar connected at both ends thereof to said body member which substantially encloses said supporting means, yieldable means for urging said cam member against said cross bar, and said rod being connected to said central part of the front end of said lever through said horizontally elongated slot in said supporting means.

* * * * *

UNITED STATES PATENT OFFICE

CERTIFICATE OF CORRECTION

Patent No. 4,066,277 Dated January 3, 1978

Inventor(s) Masahiro Murata

It is certified that error appears in the above-identified patent and that said Letters Patent are hereby corrected as shown below:

Col. 5, line 14, after "34" insert --of--;

Col. 6, line 4, "and" should be --said--.

Signed and Sealed this

*Twenty-eighth* Day of *March 1978*

[SEAL]

*Attest:*

RUTH C. MASON
*Attesting Officer*

LUTRELLE F. PARKER
*Acting Commissioner of Patents and Trademarks*